US010811849B2

(12) United States Patent
Miyake et al.

(10) Patent No.: US 10,811,849 B2
(45) Date of Patent: Oct. 20, 2020

(54) IGNITION DEVICE

(71) Applicant: DENSO CORPORATION, Kariya, Aichi-pref. (JP)

(72) Inventors: Keiko Miyake, Kariya (JP); Takashi Ohno, Kariya (JP); Shunichi Takeda, Kariya (JP); Kanechiyo Terada, Kariya (JP)

(73) Assignee: DENSO CORPORATION, Kariya (JP)

( * ) Notice: Subject to any disclaimer, the term of this patent is extended or adjusted under 35 U.S.C. 154(b) by 336 days.

(21) Appl. No.: 15/997,993

(22) Filed: Jun. 5, 2018

(65) Prior Publication Data

US 2018/0358782 A1 Dec. 13, 2018

(30) Foreign Application Priority Data

Jun. 7, 2017 (JP) ..... 2017-112441

(51) Int. Cl.

| | |
|---|---|
| ***F02P 3/01*** | (2006.01) |
| ***F02P 3/05*** | (2006.01) |
| ***F02P 3/12*** | (2006.01) |
| ***H01T 13/04*** | (2006.01) |
| ***F02P 7/077*** | (2006.01) |
| ***F02P 15/10*** | (2006.01) |

(Continued)

(52) U.S. Cl.

CPC ..... *H01T 13/04* (2013.01); *F02P 3/01* (2013.01); *F02P 7/077* (2013.01); *F02P 15/10* (2013.01); *F02P 3/0442* (2013.01); *F02P 3/05* (2013.01); *F02P 3/051* (2013.01); *F02P 3/053* (2013.01); *F02P 3/12* (2013.01); *F02P 9/007* (2013.01); *F02P 2017/121* (2013.01)

(58) Field of Classification Search

CPC ..... F02P 3/01; F02P 3/05; F02P 3/051; F02P 3/12

USPC ..... 361/253, 263

See application file for complete search history.

(56) References Cited

U.S. PATENT DOCUMENTS

| | | | | |
|---|---|---|---|---|
| 6,675,784 | B2 * | 1/2004 | Nagase | F02P 3/051 123/603 |
| 7,392,798 | B2 * | 7/2008 | Wada | F02P 3/051 123/620 |

(Continued)

FOREIGN PATENT DOCUMENTS

| | | |
|---|---|---|
| JP | 2007-092605 | 4/2007 |
| JP | 2015-200284 | 11/2015 |
| JP | 2016-053358 | 4/2016 |

*Primary Examiner* — Gary A Nash

(74) *Attorney, Agent, or Firm* — Nixon & Vanderhye PC

(57) ABSTRACT

An ignition device for generating a spark discharge at a spark plug based on a first voltage from a first supply and a second voltage from a second supply. The second voltage is higher than the first voltage. In the ignition device, a primary coil includes a center tap, a first terminal on a ground side of the center tap, and a second terminal on a first-supply side of the center tap, and a secondary coil is electromagnetically coupled to the primary coil and electrically connected to the spark plug. A first switch is configured to make or break an electrical connection between the first terminal and ground, a second switch is configured to make or break an electrical connection between the second supply and the center tap, and a third switch is configured to pass or interrupt a current from the second terminal to the first supply. A controller is configured to control an on/off state of each of the first to third switches.

12 Claims, 9 Drawing Sheets

(51) Int. Cl.

| | |
|---|---|
| *F02P 17/12* | (2006.01) |
| *F02P 3/04* | (2006.01) |
| *F02P 9/00* | (2006.01) |

(56) References Cited

U.S. PATENT DOCUMENTS

| | | | | |
|---|---|---|---|---|
| 8,861,175 | B2 * | 10/2014 | Godo | F23Q 3/004<br>361/263 |
| 2016/0084215 | A1 * | 3/2016 | Kondou | F02P 3/0435<br>123/620 |
| 2016/0201637 | A1 | 7/2016 | Sekine | |
| 2017/0022960 | A1 * | 1/2017 | Takeda | F02P 3/0442 |

* cited by examiner

IGNITION DEVICE

CROSS-REFERENCE TO RELATED APPLICATION

This application is based on and claims the benefit of priority from earlier Japanese Patent Application No. 2017-112441 filed on Jun. 7, 2017, the description of which is incorporated herein by reference.

BACKGROUND

Technical Field

The present disclosure relates to an ignition device operable to generate a spark discharge at a spark plug.

Related Art

Conventionally, an ignition device is known, which includes a main ignition circuit operable to generate a spark discharge at a spark plug through energization control of a primary coil of ignition coils and an energy input circuit operable to input electrical energy to the primary coil during the spark discharge (see, for example, Japanese Patent Application Laid-Open Publication No. 2015-200284). In the ignition device disclosed in Japanese Patent Application Laid-Open Publication No. 2015-200284, the spark discharge initiated by activation of the main ignition circuit is continued by the energy input circuit passing through a secondary coil of the ignition coils a secondary current having the same polarity as the secondary current generated upon activation of the main ignition circuit.

Ignition energy required for combustion may vary with environment in which the ignition is carried out by the ignition device, such as an internal-combustion engine load, an engine speed, the presence or absence of supercharging or exhaust gas recirculation (EGR), lean-burn or the like. An optimum ignition method may be different for different environments. Even though the ignition device as disclosed Japanese Patent Application Laid-Open Publication No. 2015-200284 is configured such that the main ignition by induction discharge and the ignition by energy input can be carried out by a main ignition circuit and an energy input circuit, respectively, there is still room for improvement.

In view of the above, an ignition device capable of selectively performing more ignition methods is desired.

SUMMARY

One aspect of the disclosure provides an ignition device for generating a spark discharge at a spark plug based on a first voltage and a second voltage higher than the first voltage, the first voltage being supplied from a first supply, the second voltage being supplied from a second supply. The ignition device includes: the second supply; a primary coil including a center tap, a first terminal on a ground (GND) side of the center tap, and a second terminal on a first-supply side of the center tap; a secondary coil electromagnetically coupled to the primary coil and electrically connected to the spark plug; a first switch configured to make or break an electrical connection between the first terminal and GND; a second switch configured to make or break an electrical connection between the second supply and the center tap; a third switch configured to pass or interrupt a current from the second terminal to the first supply; and a controller configured to control an on/off state of each of the first switch, the second switch, and the third switch.

With this configuration, the on/off state of each of the first switch, the second switch, and the third switch is controlled by the controller. This allows the ignition device to select one of the following three ignition methods in response to engine operating condition and carry out the selected ignition method.

The second switch breaks the electrical connection between the second supply and the center tap, the third switch makes the electrical connection between the first supply and the second terminal, and the first switch makes the electrical connection between the first terminal and GND, thereby allowing the primary current to flow from the second terminal of the primary coil to the first terminal. Thereafter, the first switch breaks the electrical connection between the first terminal and GND, thereby generating a high voltage across the secondary coil. This allows the "main ignition by induction discharge" at the spark plug to be implemented.

After initiation of the main ignition by induction discharge, the first switch is placed in the off state (the disconnected state), the third switch is placed in the on state (the connected state), and the second switch makes the electrical connection between the second supply and the center tap, thereby allowing the primary current to flow from the center tap of the primary coil to the second terminal (energy input). The second supply then supplies the second voltage higher than the first voltage and the number of turns from the center tap to the second terminal is less than the number of turns from the first terminal to the second terminal. This can provide a current flow at a higher voltage than a discharge sustainable voltage Vm that is a voltage required to sustain the discharge at the spark plug, and an additional secondary current flows through the secondary coil in the same direction as the secondary current flows through the secondary coil at the time of the main ignition by induction discharge. Thereafter, the secondary current can be continued by controlling the second switch alternately to the on state and the off state to thereby control the secondary current to a target current that can sustain the discharge, which allows the "ignition by energy input" at the spark plug to be implemented.

After initiation of the main ignition by induction discharge, the third switch is placed in the off state (the disconnected state), the second switch is placed in the on state (the connected state), and the first switch makes the electrical connection between the first terminal and GND, thereby allowing the primary current to flow from the center tap of the primary coil to the first terminal (rapid energization). The second supply then supplies the second voltage higher than the first voltage and the number of turns from the center tap of the primary coil to the first terminal is less than the number of turns from the second terminal to the first terminal. This can provide a higher rate of increase in the primary current as compared to the case of the main ignition by induction discharge, which allows the primary current to rapidly flow through the primary coil in the same direction as the primary current flows through the primary coil at the time of the main ignition by induction discharge. Thereafter, a high voltage is generated across the secondary coil by the first switch breaking the electrical connection between the first terminal and GND, which implements the multiple ignition by rapid energization. The rapid energization and the induction discharge at the spark plug are repeated alternately by controlling the first switch alternately to the on state and the off state, which can implement the "multiple ignition by rapid energization" at the spark plug. As above, selecting and performing one of the above three ignition methods allows the ignition to be carried out with optimal power consumption.

DESCRIPTION OF SPECIFIC EMBODIMENTS

With reference to the accompanying drawings, hereinafter are described several embodiments of the present disclosure. Substantially common elements throughout the embodiments are assigned the same numbers and will not be redundantly described. In one embodiment of the present disclosure, an engine may be a direct cylinder injection type engine that can run lean. The engine includes a turbulent flow controller for generating a turbulent flow, such as a tumble flow, a swirl flow or the like, of an air-fuel mixture within a cylinder. The ignition device is operable to ignite the air-fuel mixture in a combustion chamber at a predefined timing. The ignition device is a direct ignition (DI) type ignition device using an ignition coil corresponding to a spark plug for a respective one of multiple cylinders of the engine.

Figure 1:
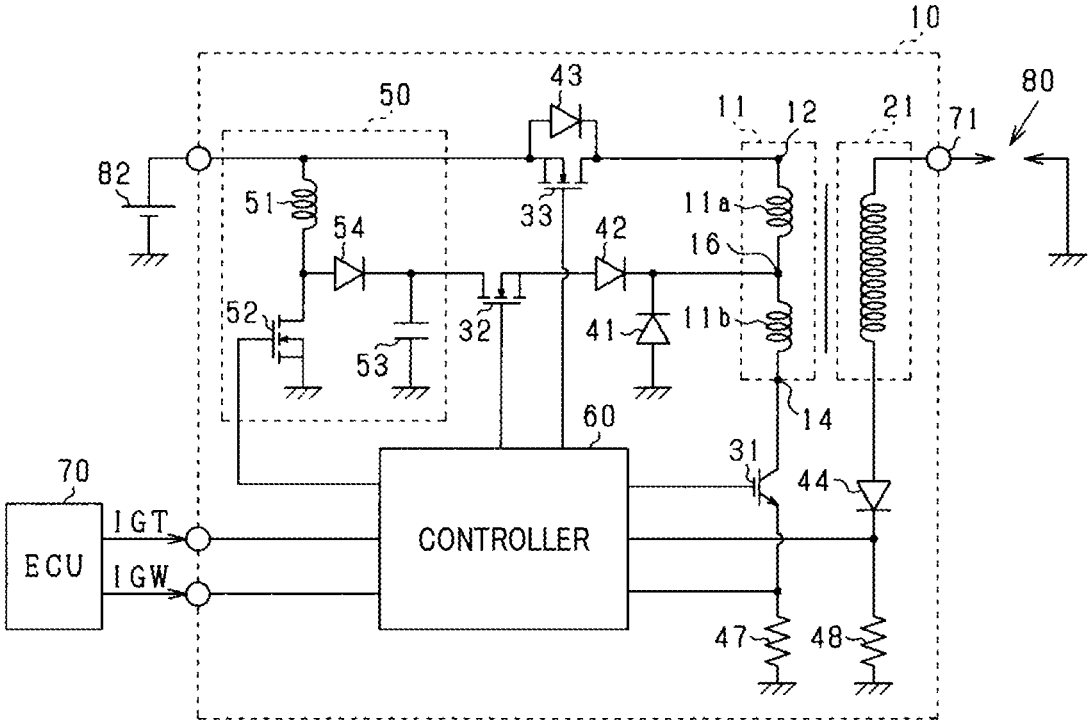
FIG. 1 is a circuit diagram of an ignition device in accordance with one embodiment.

As shown in FIG. 1, the ignition device 10 is configured to control energization of a primary coil 11 that is an ignition coil in response to instruction signals including a main ignition signal IGT and an energy input signal IGW received from an engine electronic control unit (ECU) configured as a main controller for controlling the engine. By controlling the energization of the primary coil 11, the ignition device 10 controls electrical energy generated in a secondary coil 21, thereby controlling a spark discharge at a spark plug 80. The primary coil 11 and the secondary coil 21 are ignition coils.

The ECU 70 is configured to output the main ignition signal IGT and the energy input signal IGW in response to engine parameters, such as a warming up state, an engine speed, an engine load or the like, acquired from various sensors, and an engine control state (the presence or absence of lean combustion, the magnitude of the turbulent flow or the like).

The ignition device 10 includes the primary coil 11, the secondary coil 21, switching elements 31-33, a boost circuit 50, diodes 41-44, current sensing resistors 47, 48, and a control circuit 60. A spark plug 80 is provided for each cylinder of the engine. The primary coil 11 and the secondary coil 21 are provided for each spark plug 80. In the following description, a configuration corresponding to one of the spark plugs 80 will be described as a representative example. Components of the ignition device 10 are housed within a case containing the primary coil 11 and the secondary coil 21.

The spark plug 80, which has a well-known configuration, includes a central electrode electrically connected to one of ends of the secondary coil 21 via an output terminal 71, and an outside electrode electrically connected to ground (GND) via an engine cylinder head or the like. The other end of the secondary coil 21 is electrically connected to ground via the diode 44 and the current sensing resistor 48. An anode of the diode 44 is electrically connected to the secondary coil 21, and a cathode of the diode 44 is electrically connected to the current sensing resistor 48. The current sensing resistor 48 is operable to detect a secondary current flow though the secondary coil 21. An output of the current sensing resistor 48 is fed to the control circuit 60. The diode 44 inhibits a spark discharge from an undesired voltage generated during energization of the primary coil 11. The spark plug 80 generates a spark discharge between the central electrode and the outside electrode from electrical energy generated across the secondary coil 21.

The ignition coils include the primary coil 11 and the secondary coil 21 electromagnetically coupled to the primary coil 11. The number of turns in the secondary coil 21 is greater than the number of turns in the primary coil 11.

The primary coil 11 has the source terminal 12, a GND terminal 14, a center tap 16. A portion of the primary coil 11 between the source terminal 12 and the center tap 16 is a first winding 11*a* and a portion of the primary coil 11 between the center tap 16 and the GND terminal 14 is a second winding 11*b*.

The source terminal 12 (as a second terminal) is electrically connected via the switching element 33 and the diode 43 to a battery 82. The battery 82 (as a first supply) may be a well-known lead battery that supplies a voltage of 12 V (as a first voltage). An anode of the diode 43 is electrically connected to the battery 82, and a cathode of the diode 43 is electrically connected to the source terminal 12. The switching element 33 is a semiconductor switching element, such as a power transistor or a metal-oxide semiconductor (MOS) transistor, and is electrically connected in parallel with the diode 43. An on/off state of the switching element 33 is controlled by the control circuit 60. The diode 43 may be a parasitic diode of the MOS transistor. The switching element 33 and the diode 43 form a third switch operable to admit or interrupt a current flow from the source terminal 12 to the battery 82.

The GND terminal 14 (as a first terminal) of the primary coil 11 is electrically connected to the switching element 31. The switching element 31 (as a first switch) is a semiconductor switching element, such as a power transistor or a metal-oxide semiconductor (MOS) transistor. An output terminal of the switching element 31 is electrically connected to GND via the current sensing resistor 47 (as a current detecting circuit). The switching element 31 is operable to make or break an electrical connection between the GND terminal 14 and GND in response to a signal from the control circuit 60. The current sensing resistor 47 is operable to detect a primary coil current flowing through the switching element 31. An output of the current sensing resistor 47 is fed to the control circuit 60.

The center tap 16 of the primary coil 11 is electrically connected to the switching element 32 via the diode 42. An anode of the diode 42 is electrically connected to the switching element 32, and a cathode of the diode 42 is electrically connected to the center tap 16. The switching element 32 (as a second switch) is a semiconductor switching element, such as a power transistor or a MOS transistor. An input terminal of the switching element 32 is electrically connected via the boost circuit 50 to the battery 82. The switching element 32 is operable to make or break an electrical connection between the boost circuit 50 and the center tap 16 in response to a signal from the control circuit 60. A cathode of the freewheeling diode 41 is electrically connected between the diode 42 and the center tap 16. An anode of the freewheeling diode 41 is electrically connected to GND.

The boost circuit 50 (as a second supply) includes a choke coil 51, a switching element 52, a capacitor 53, and a diode 54. The choke coil 51 is electrically connected to the battery 82. The switching element 52 is a semiconductor switching element, such as a power transistor or a MOS transistor. The switching element 52 is operable to pass and block a current from the battery 82 to the choke coil 51. An on/off state of the switching element 52 is controlled by the control circuit 60. Electrical energy stored in the choke coil 51 is charged in the capacitor 53 by controlling the on/off state of the switching element 52. The diode 54 is operable to block the electrical energy stored in the capacitor 53 from flowing back to the choke coil 51. By controlling the switching element 32 to the on state, the boost circuit 50 supplies a stepped-up voltage of from tens to hundreds of volts (as a second voltage) to the center tap 16.

The control circuit 60 (as a controller) includes an input-output interface, a drive circuit and others. The control circuit 60 is configured to control an on/off state of each of switching elements 31-33, 52 in response to signals from the ECU 70 and outputs of the current sensing resistors 47, 48. The control circuit 60 selects one of three ignition methods, that is, main ignition by induction discharge, ignition by energy input, and multiple ignition by rapid energization.

Figure 2:
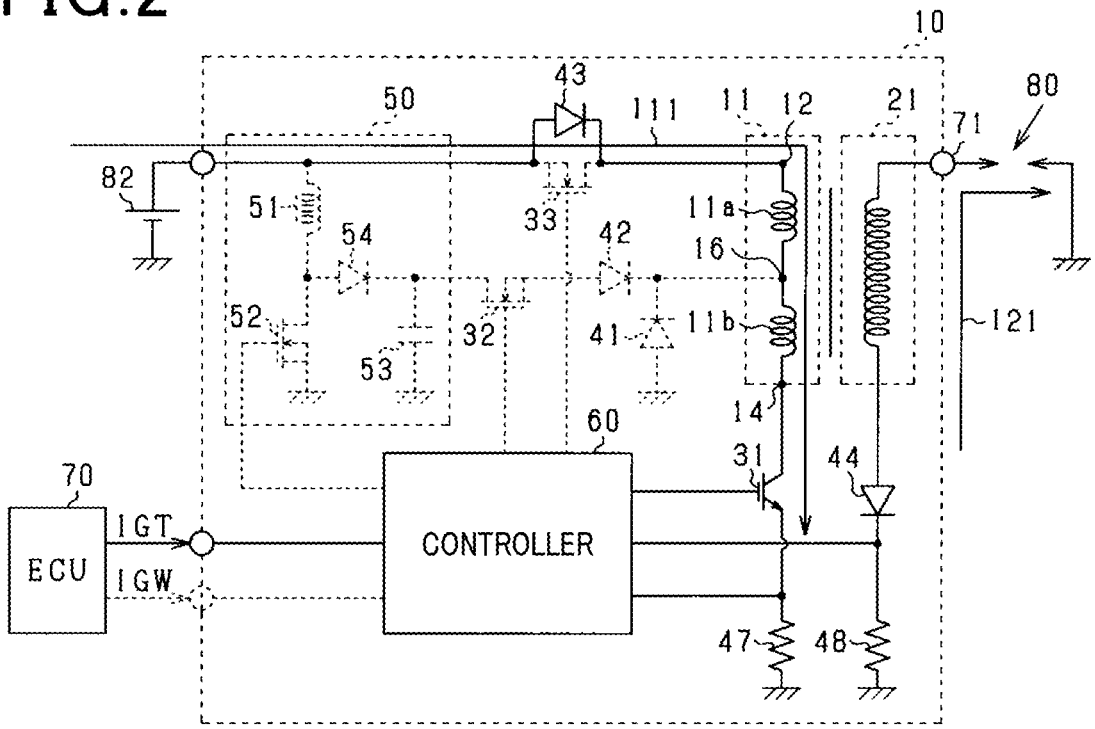
FIG. 2 is a circuit diagram for main ignition by induction discharge.

FIG. 2 is a circuit diagram illustrating an implementation of the main ignition by induction discharge. As shown in FIG. 2, when the switching element 32 breaks an electrical connection between the boost circuit 50 and the center tap 16 and the switching element 31 makes an electrical connection between the GND terminal 14 and GND, the primary current I11 flows from the source terminal 12 of the primary coil 11 to the GND terminal 14. While the switching element 33 is in an off state, the diode 43 makes an electrical connection between the battery 82 and the source terminal 12. The diode 44 blocks the secondary current I21 that tends to flow upon initiation of energization of the primary coil 11. Thereafter, a high voltage will be generated across the secondary coil 21 when the switching element 31 breaks the electrical connection between the GND terminal 14 and GND. The main ignition by induction discharge at the spark plug 80 is thus implemented. For the main ignition by induction discharge, the switching element 33 may be in a conduction state.

Figure 3:
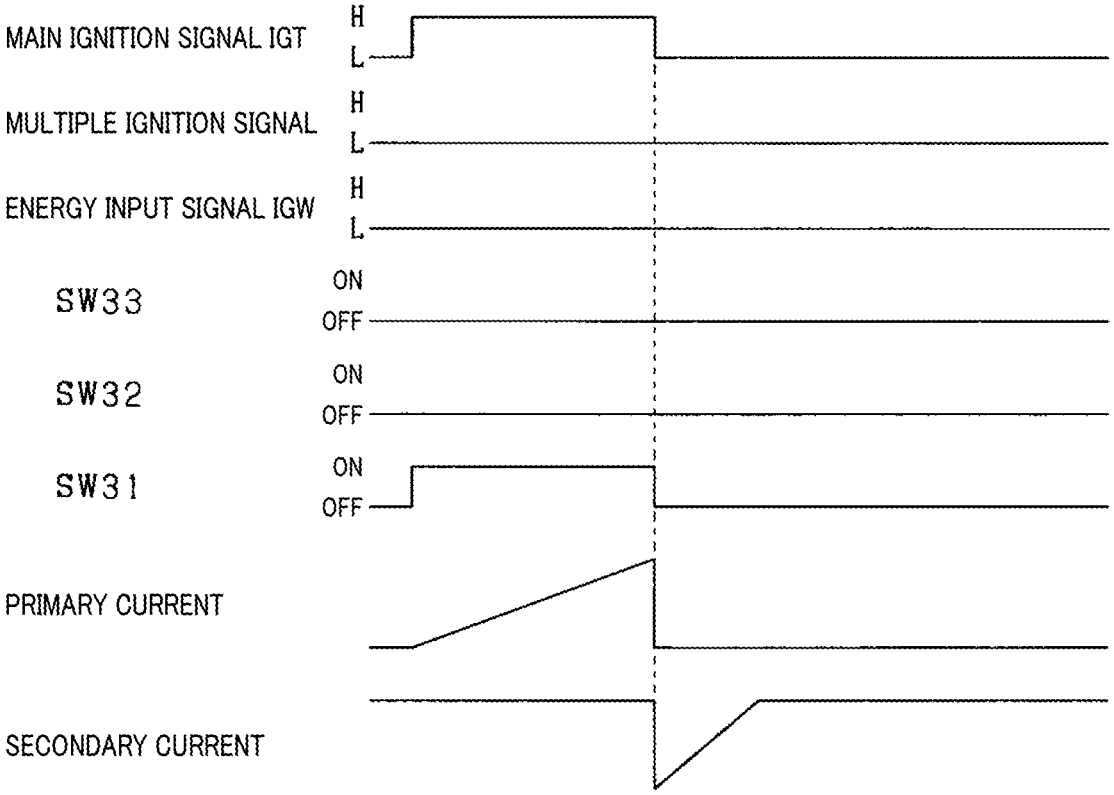
FIG. 3 is a timing diagram for the main ignition by induction discharge.

FIG. 3 is a timing diagram for the implementation of the main ignition by induction discharge. As shown in FIG. 3, the control circuit 60 controls the switching element 31 to the on state during a time period in which a main ignition signal IGT from the ECU 70 is high (H). A voltage of the battery 82 (referred to as a battery voltage) is thus applied to the entire winding (the first winding 11*a*+the second winding 11*b*) of the primary coil 11. At the time instant when the main ignition signal IGT becomes low (L) as a result of increase in the primary current I11, the control circuit 60 controls the switching element 31 to the off state. A high voltage is thereby generated across each of the primary coil 11 and the secondary coil 21. A spark discharge at the spark plug 80 is thus generated, so that a secondary current flows though the secondary coil 21. Thereafter, when the secondary current decreases to below a discharge sustainable current that is a minimum current which can sustain the discharge, the discharge at the spark plug 80 terminates.

Figure 4:
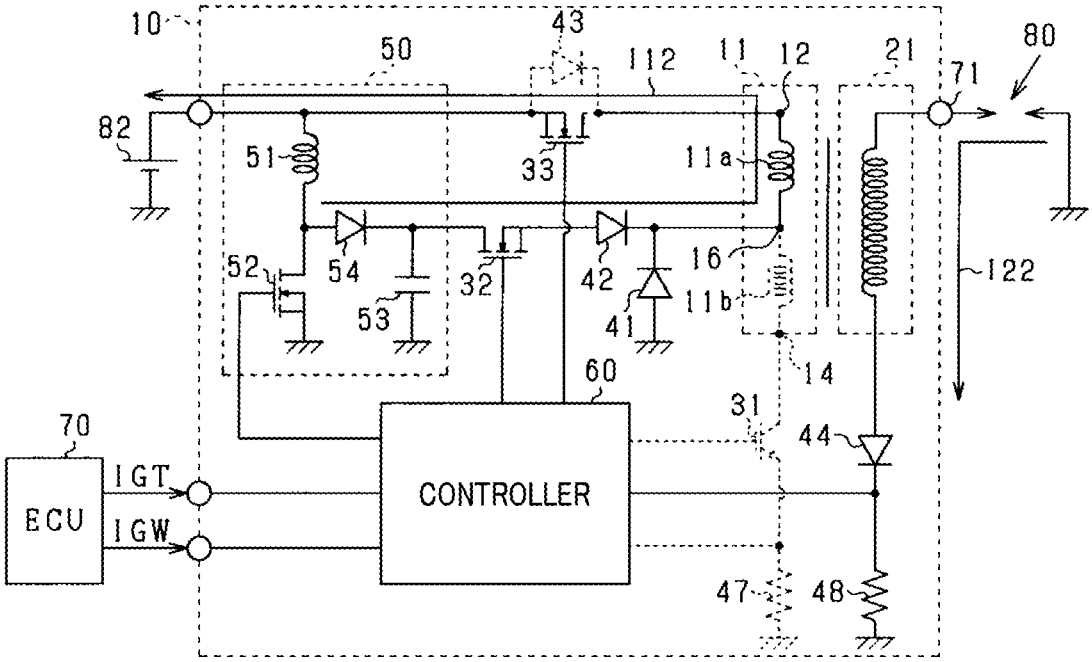
FIG. 4 is a circuit diagram for ignition by energy input.

FIG. 4 is a circuit diagram illustrating an implementation of the ignition by energy input. As shown in FIG. 4, after initiation of the main ignition by induction discharge, the switching element 31 is placed in the off state (the disconnected state), the switching element 33 is placed in the on state (the connected state), and the switching element 32 is placed in the on state (the connected state), thereby allowing the primary current I12 to flow from the center tap 16 of the primary coil 11 to the source terminal 12 of the first winding 11*a* (energy input). A high voltage thus generated is in the same direction as the high voltage generated in the main ignition by induction discharge, which gives rise to a current superimposed on the secondary current I22. Thereafter, the secondary current I22 is controlled to a predetermined value by controlling the switching element 32 alternately to the on state and the off state, thereby implementing the ignition by energy input at the spark plug 80.

The ignition device 10 includes a freewheeling diode 41. Therefore, in the ignition by energy input, upon the switching element 32 being placed in the disconnected state, a freewheeling current flows through a freewheeling current path: GND->the freewheeling diode 41->the center tap 16->the source terminal 12->the switching element 33->the battery 82->GND. This can suppress a rapid decrease in the primary current I12, which can make it easy to control the secondary current I22 to a predetermined value.

Figure 5:
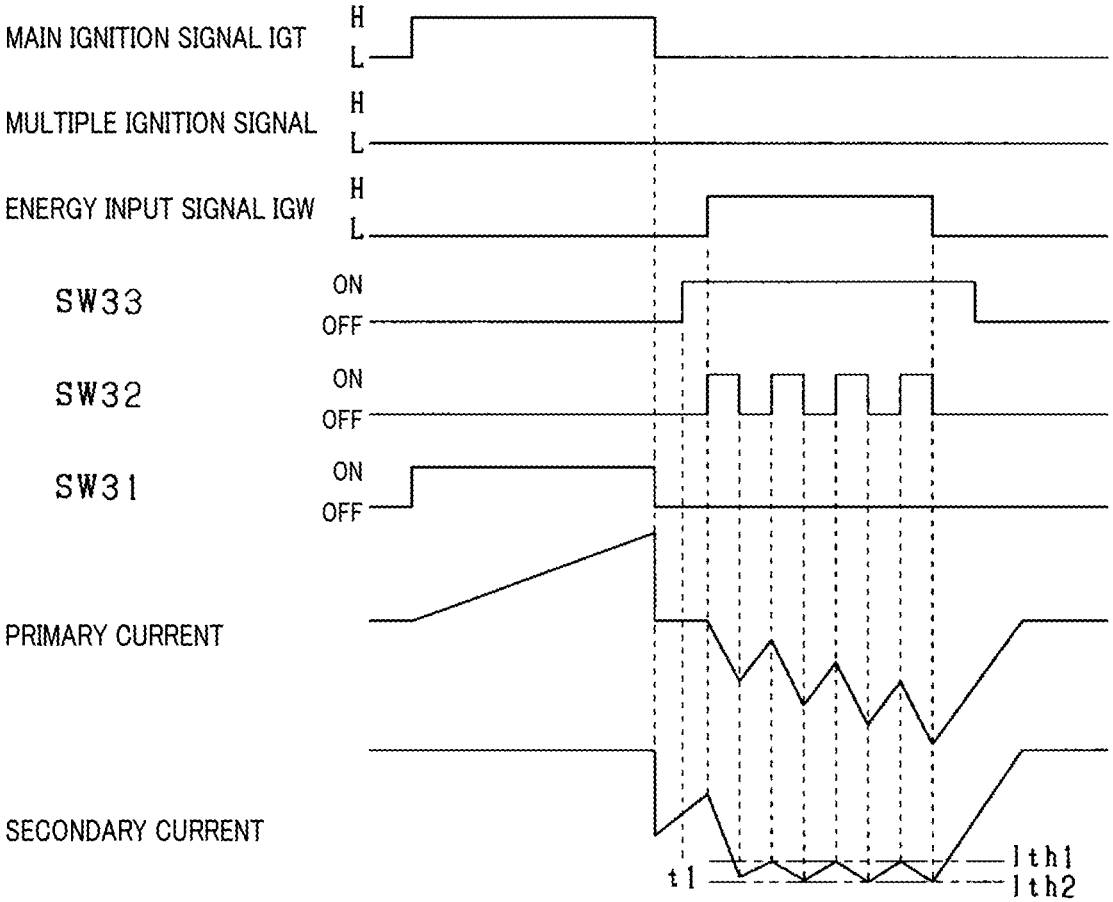
FIG. 5 is a timing diagram for the ignition by energy input.

FIG. 5 is a timing diagram for the implementation of the ignition by energy input. As shown in FIG. 5, after initiation of the main ignition by induction discharge as described with reference to FIG. 3, the control circuit 60 controls the switching element 33 to the on state at time t1. The control circuit 60 steps up the battery voltage to charge the capacitor 53 in the boost circuit 50 during a time period in which the main ignition signal IGT from the ECU 70 is high (H).

Thereafter, the control circuit 60 controls the switching element 32 alternately to the on state and the off state during a time period in which the energy input signal IGW from the ECU 70 is high (H). The boost circuit 50 supplies a stepped-up voltage higher than the battery voltage and the number of turns in the first winding 11*a* through which the primary current I12 flows is less than the number of turns in the primary coil 11 (see FIG. 4). This can provide a current flow at a higher voltage than a discharge sustainable voltage Vm that is a voltage required to sustain the discharge at the spark plug 80, and an additional secondary current I22 flows through the secondary coil 21 in the same direction as the secondary current flows through the secondary coil 21 at the time of the main ignition by induction discharge. More specifically, the number of turns T1 in the first winding 11*a* and the number of turns T2 in the secondary coil 21 are set such that a turn number ratio Tr=T2/T1 and Tr>Vm/(Vh−Vb), where Vb is the battery voltage, Vh is the output voltage of the boost circuit 50, and Vm is the discharge sustainable voltage Vm. The discharge sustainable voltage Vm is a voltage required to sustain the discharge at the spark plug 80. Passing the primary current I12 while sustaining the discharge at the spark plug 80 can implement the ignition by energy input.

The control circuit 60 is configured to feedback control the on/off state of the switching element 32 such that the secondary current I22 detected by the current sensing resistor 48 is maintained between a lower limit Ith1 and an upper limit Ith2. The lower limit Ith1 and the upper limit Ith2 may be fixed values or may be variably set depending on the engine operating condition. At the time instant when the energy input signal IGW becomes low (L), the control circuit 60 controls the switching element 32 to the off state. Then, the control circuit 60 controls the switching element 33 to the off state. In an alternative embodiment, the control circuit 60 may be configured to feedforward control the on/off state of the switching element 32 such that the secondary current I22 is maintained between the lower limit Ith1 and the upper limit Ith2.

Figure 6:
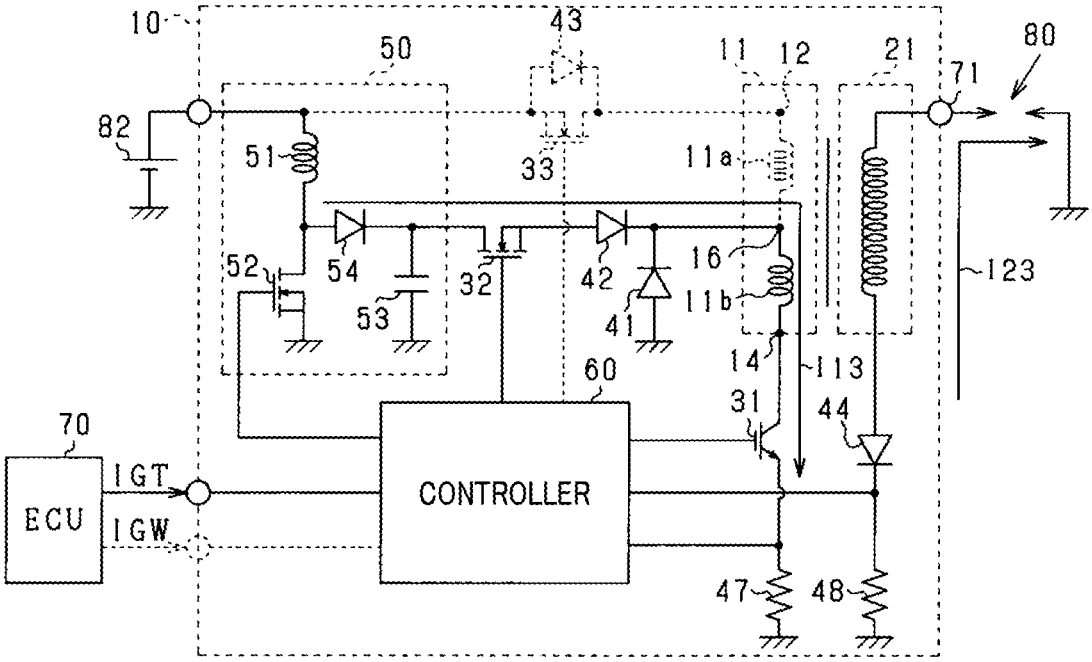
FIG. 6 is a circuit diagram for multiple ignition by rapid energization.

FIG. 6 is a circuit diagram illustrating an implementation of the multiple ignition by rapid energization. As shown in FIG. 6, after initiation of the main ignition by induction discharge, the switching element 33 is placed in the off state (the disconnected state), the switching element 32 is placed in the on state (the connected state), and the switching element 31 is placed in the on state (the connected state), whereby the primary current I13 flows from the center tap 16 of the primary coil 11 to the GND terminal 14 through the second winding 11*b* (rapid energization). The diode 44 blocks the secondary current I23 that tends to flow upon initiation of energization of the primary coil 11. Thereafter, a high voltage is generated across the secondary coil 21 by controlling the switching element 31 to the off state, which implements the multiple ignition by rapid energization. The rapid energization of the second winding 11*b* and the induction discharge at the spark plug 80 are repeated alternately by controlling the switching element 31 alternately to the on state and the off state, which implements the multiple ignition by rapid energization at the spark plug 80.

Figure 7:
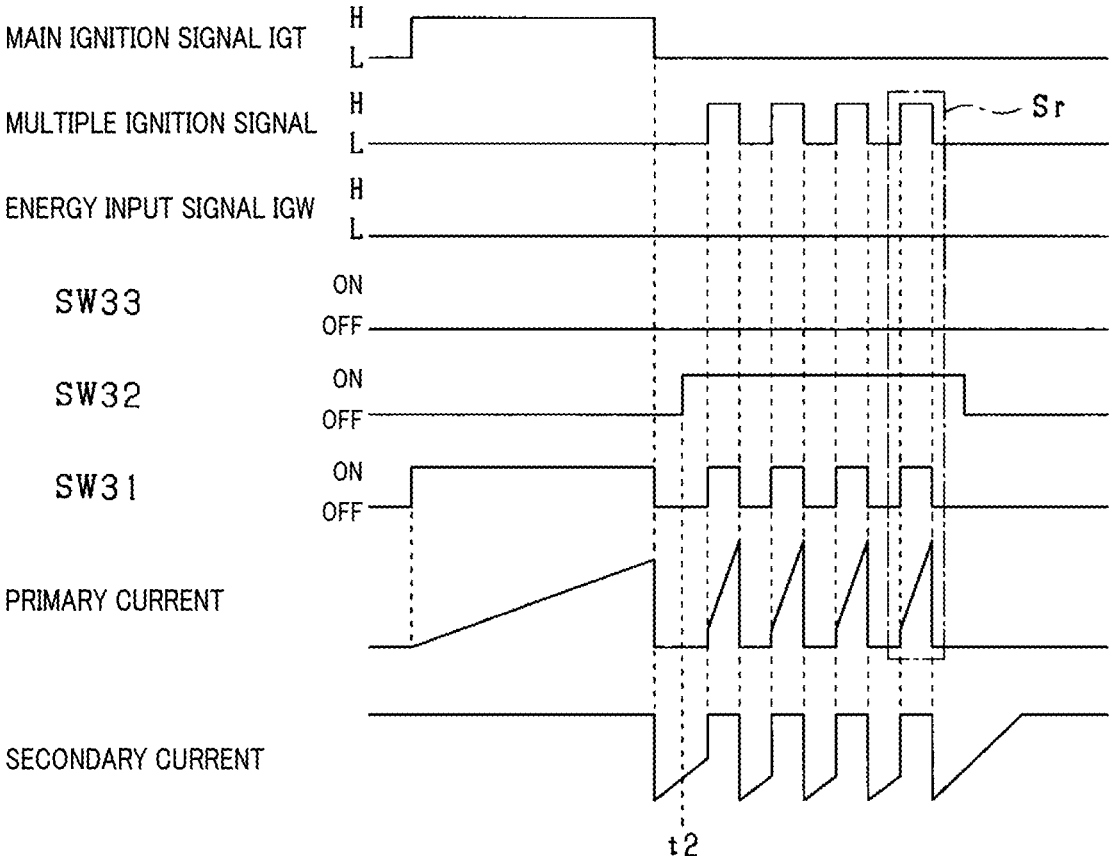
FIG. 7 is a timing diagram for the multiple ignition by rapid energization.

FIG. 7 is a timing diagram for the implementation of the multiple ignition by rapid energization. As shown in FIG. 7, after initiation of the main ignition by induction discharge as described with reference to FIG. 3, the control circuit 60 controls the switching element 32 to the on state at time t2. The control circuit 60 steps up the battery voltage to charge the capacitor 53 in the boost circuit 50 during a time period in which the main ignition signal IGT from the ECU 70 is high (H).

Thereafter, the control circuit 60 controls the switching element 31 to the on state during a time period in which the multiple ignition signal is high (H). The boost circuit 50 supplies a stepped-up voltage higher than the battery voltage and the number of turns in the second winding 11*b* through which the primary current I13 flows is less than the number of turns in the primary coil 11 (see FIG. 6). This can provide a higher rate of increase in the primary current I13 as compared to the case of the main ignition by induction discharge, whereby the primary current I13 rapidly flows through the second winding 11*b* in the same direction as the primary current flows through the second winding 11*b* at the time of the main ignition by induction discharge. At the time instant when the multiple ignition signal becomes low (L), the control circuit 60 controls the switching element 31 to the off state. The secondary current then flows through the secondary coil 21, whereby a spark discharge is generated at the spark plug 80. Thereafter, the switching element 31 is controlled alternately to the on state and the off state in response to whether the multiple ignition signal is high (H) or low (L). Once the number of times the switching element 31 has been controlled alternately to the on state and the off state has reached a predetermined number, the control circuit 60 controls the switching element 32 to the off state. The predetermined number may be a fixed number or may be variably set depending on the engine operating condition. In addition, the multiple ignition signal may be instructed by the control circuit 60 or may be instructed by the ECU 70 to the control circuit 60.

Figure 8:
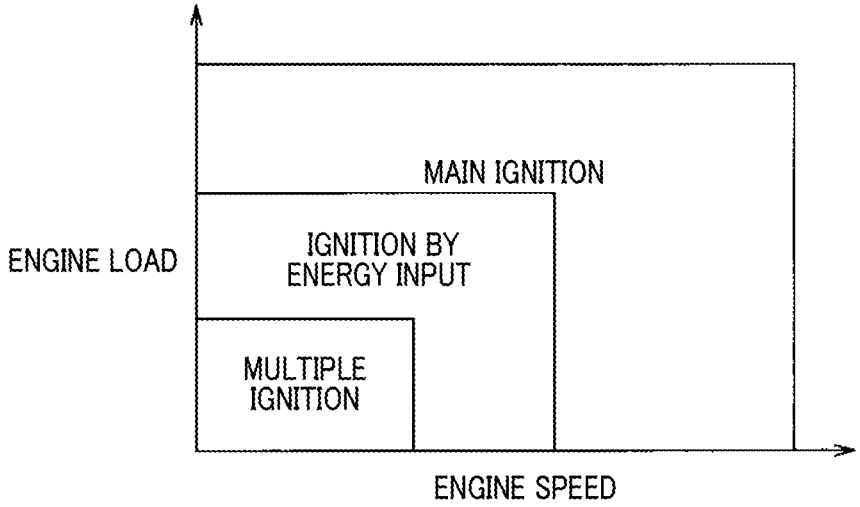
FIG. 8 is a schematic illustration of a relationship between engine operating conditions and ignition methods.

FIG. 8 is a schematic illustration of a relationship between engine operating conditions and ignition methods. As shown in FIG. 8, the ECU 70 is configured to cause the control circuit 60 to selectively carry out the main ignition by induction discharge, the ignition by energy input, and the multiple ignition by rapid energization in response to the engine speed and the engine load. The main ignition by induction discharge may be suitable where the engine operating condition is within a stoichiometric range because of the least consumption energy and less spark energy of the main ignition by induction discharge. The ignition by energy input carried out in superposition on the main ignition by induction discharge requires the most input energy because it is necessary to continue the secondary current of the same polarity. However, the ignition by energy input may be suitable where the airflow velocity in the engine is high due to supercharging or exhaust gas recirculation (EGR) input and the spark is thus swept away and stretched or blown out by the airflow. The multiple ignition by rapid energization can be carried out with less energy consumption than the ignition by energy input because the secondary current is passed intermittently. During the multiple ignition by rapid energization, however, the spark discharge is generated intermittently. Therefore, the multiple ignition by rapid energization may be suitable where the airflow velocity in the engine cylinder is relatively low as compared to when the ignition by energy input is carried out and the ignition flame kernel is not brought out of proximity with the spark plug 80. That is, the ECU 70 is configured to select one of these three ignition methods in response to an environment in which the ignition is carried out at the spark plug 80 and cause the control circuit 60 to carry out the selected ignition method. More specifically, the main ignition by induction discharge is carried out in the high engine speed and high load range where the engine is operated in a stoichiometric operating condition. The ignition by energy input is carried out in the medium engine speed and medium load range where the engine is operated in a lean-burn operating condition. The multiple ignition by rapid energization is carried out in the low engine speed and low load range where the engine is operated in a lean-burn operating condition.

Figure 9:
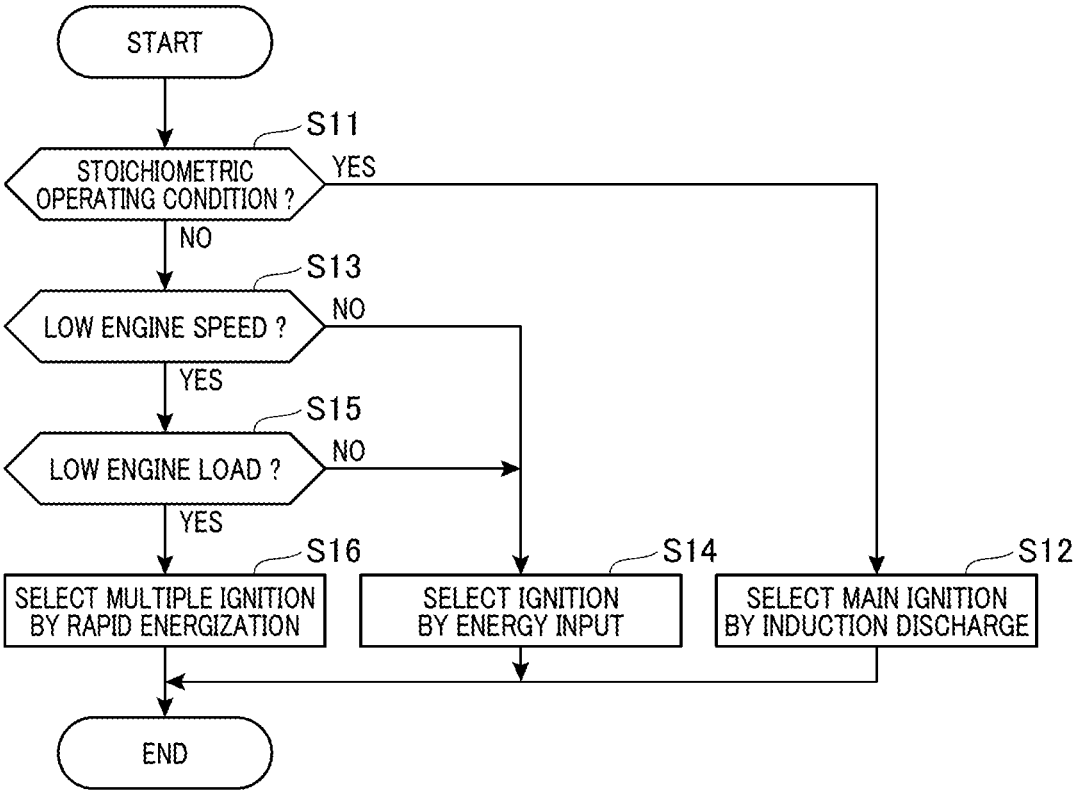
FIG. 9 is a flowchart of selecting one of the ignition methods.

FIG. 9 is a flowchart of processing steps for selecting one of the ignition methods. These processing steps are performed by the ECU 70. At step S11, the ECU 70 determines whether or not the engine operating condition is a stoichiometric operating condition. If it is determined that the engine operating condition is a stoichiometric operating condition (the "YES" branch of step S11), then at step S12 the ECU 70 selects the main ignition by induction discharge. If it is determined that the engine operating condition is not a stoichiometric operating condition (the "NO" branch of step S11), then at step S13 the ECU 70 determines whether or not the engine speed is within a low speed range. If it is determined that the engine speed is not within the low speed range, then at step S14 the ECU 70 selects the ignition by energy input. If it is determined that the engine speed is within the low speed range (the "YES" branch of step S13), then at step S15 the ECU 70 determines whether or not the engine load is within a low load range. If it is determined that the engine load is not within the low load range (the "NO" branch of step S15), then at step S14 the ECU 70 selects the ignition by energy input. If it is determined that the engine load is within the low load range (the "YES" branch of step S15), then at step S16 the ECU 70 selects the multiple ignition by rapid energization.

The embodiment set forth above can provide the following advantages.

(A1) The switching element 32 breaks an electrical connection between the boost circuit 50 and the center tap 16, the diode 43 makes an electrical connection between the battery 82 and the source terminal 12, and the switching element 31 makes an electrical connection between the GND terminal 14 and GND, thereby allowing the primary current I11 to flow from the source terminal 12 of the primary coil 11 to the GND terminal 14. Thereafter, the switching element 31 breaks the electrical connection between the GND terminal 14 and GND, thereby generating a high voltage across the secondary coil 21. This allows the main ignition by induction discharge at the spark plug 80 to be implemented.

(A2) After initiation of the main ignition by induction discharge, the switching element 31 is placed in the off state (the disconnected state), the switching element 33 is placed in the on state (the connected state), and the switching element 32 makes the electrical connection between the boost circuit 50 and the center tap 16, thereby allowing the primary current I12 to flow from the center tap 16 of the primary coil 11 to the source terminal 12 of the first winding 11*a* (energy input). The boost circuit 50 then supplies a stepped-up voltage higher than the battery voltage and the number of turns from the center tap 16 of the primary coil 11 to the source terminal 12 is less than the number of turns from the GND terminal 14 to the source terminal 12. This can provide a current flow at a higher voltage than a discharge sustainable voltage Vm that is a voltage required to sustain the discharge at the spark plug 80, and an additional secondary current I22 flows through the secondary coil 21 in the same direction as the secondary current flows through the secondary coil 21 at the time of the main ignition by induction discharge. Thereafter, the secondary current I22 can be continued by controlling the switching element 32 alternately to the on state and the off state, which allows the ignition by energy input at the spark plug 80 to be implemented.

(A3) After initiation of the main ignition by induction discharge, the switching element 33 is placed in the off state (the disconnected state), the switching element 32 is placed in the on state (the connected state), and the switching element 31 makes the electrical connection between the GND terminal 14 and GND, thereby allowing the primary current I13 to flow from the center tap 16 of the primary coil 11 to the GND terminal 14 through the second winding 11*b* (rapid energization). The boost circuit 50 then supplies a stepped-up voltage higher than the battery voltage and the number of turns from the center tap 16 of the primary coil 11 to the GND terminal 14 is less than the number of turns from the source terminal 12 to the GND terminal 14. This can provide a higher rate of increase in the primary current I13 as compared to the case of the main ignition by induction discharge, which allows the primary current I13 to rapidly flow through the primary coil 11 in the same direction as the primary current flows through the primary coil 11 at the time of the main ignition by induction discharge. Thereafter, a high voltage is generated across the secondary coil 21 by the switching element 31 breaking the electrical connection between the GND terminal 14 and GND, which implements the multiple ignition by rapid energization. The rapid energization of the second winding 11*b* and the induction discharge at the spark plug 80 are repeated alternately by controlling the switching element 31 alternately to the on state and the off state, which can implement the multiple ignition by rapid energization at the spark plug 80.

(A4) During the multiple ignition by rapid energization, the primary current I13 is allowed to flow through the second winding 11*b* only, which can reduce the impedance of the second winding 11*b* as compared to when the primary current flows through the entire primary coil 11. This can reduce the amount of time needed to charge the second winding 11*b*, thereby allowing the ignition to be carried out intermittently at short time intervals. Therefore, where the airflow velocity in the engine is low as compared to when the ignition by energy input is carried out, the flame warmed by the ignitions will not be swept away by the airflow even in the case that there is a spacing between the successive ignitions, so that the ignition flame will likely dwell in the vicinity of the spark plug. A succession of spark discharges allows the ignition flame to be superimposed, which facilitates combustion. A subsequent spark discharge is allowed to occur until the generated ignition flame is blown out and the combustion can therefore be continued.

(A5) The current is allowed to flow from the battery 82 to the source terminal 12 via the diode 43. Therefore, the switching element 33 does not need to be controlled to carry out the main ignition by induction discharge. That is, to carry out the main ignition by induction discharge, the switching element 32 is placed in the disconnected state and the switching element 31 is placed in the connected state, which can pass the primary current I11 from the source terminal 12 of the primary coil 11 to the GND terminal 14. To carry out the ignition by energy input, the switching element 31 is placed in the disconnected state, the switching element 33 is placed in the connected state, and the switching element 32 is placed in the connected state, which can pass the primary current I12 from the center tap 16 of the primary coil 11 to the source terminal 12. To carry out the multiple ignition by rapid energization, the switching element 33 is placed in the disconnected state, the switching element 32 is placed in the connected state, and the switching element 31 is placed in the connected state, which can pass the primary current I13 from the center tap 16 of the primary coil 11 to the GND terminal 14.

(A6) The ignition device 10 includes a freewheeling diode 41. A cathode of the freewheeling diode 41 is electrically connected between the diode 42 and the center tap 16. An anode of the freewheeling diode 41 is electrically connected to GND. Therefore, in the ignition by energy input, upon the switching element 32 being placed in the disconnected state, a freewheeling current flows through a freewheeling current path: GND->the freewheeling diode 41->the center tap 16->the source terminal 12->the switching element 33->the battery 82->GND. This can suppress a rapid decrease in the primary current I12, which can make it easy to continue the secondary current I22 and sustain the spark discharge.

(A7) The ignition is carried out by the control circuit 60 according to one of the three ignition methods selected in response to an environment in which the ignition is carried out at the spark plug 80. An environment in which the ignition is carried out at the spark plug 80. Therefore, the ignition method suitable in an environment in which the ignition is carried out at the spark plug 80 can be carried out with optimal power consumption.

MODIFICATIONS

Numerous modifications, alterations, and changes to the described embodiment are possible without departing from the scope of the present invention, as defined in the appended claims. Similar elements to those of the described embodiment are assigned the same numbers and will not be redundantly described.

Figure 10:
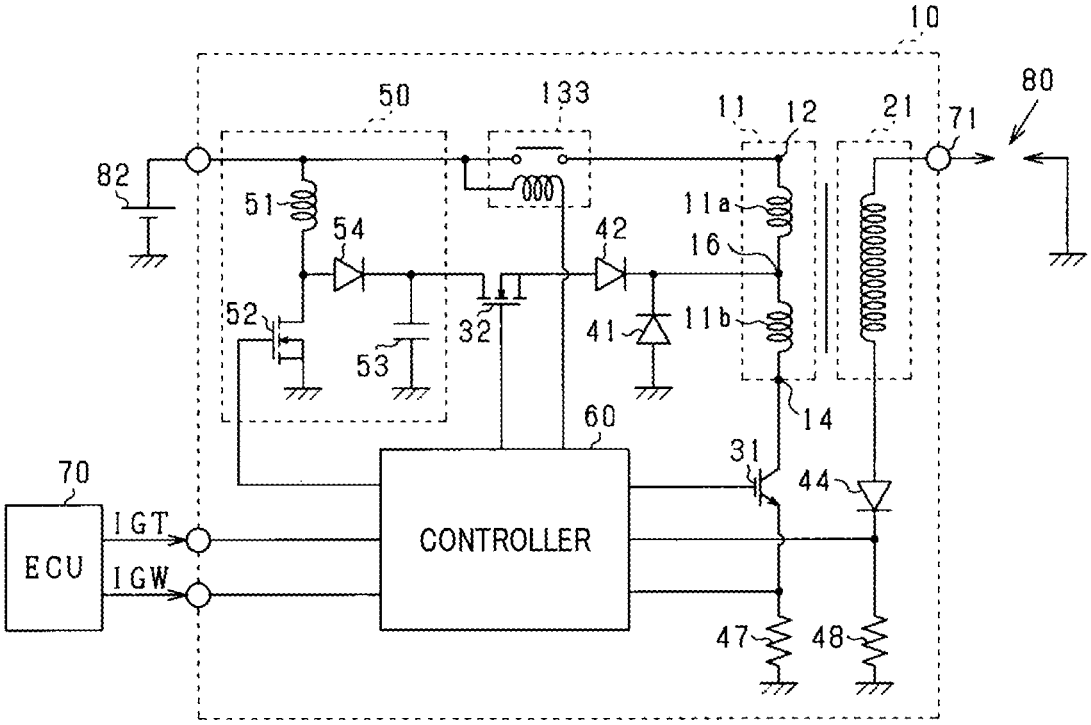
FIG. 10 is a circuit diagram of an ignition device in accordance with a modification to the embodiment.

(M1) As shown in FIG. 10, the ignition device 10 includes a switch 133 in place of the switching element 33 and the diode 43 shown in FIG. 1. The switch 133 (as a specific switch) can pass and block the current bidirectionally. The on/off state of the switch 133 is controlled by the control circuit 60.

In this configuration, to carry out the main ignition by induction discharge, the switching element 32 is placed in the disconnected state, the switch 133 is placed in the connected state, and the switching element 31 is placed in the connected state, which can pass the primary current I11 from the source terminal 12 of the primary coil 11 to the GND terminal 14. To carry out the ignition by energy input, the switching element 31 is placed in the disconnected state, the switch 133 is placed in the connected state, and the switching element 32 is placed in the connected state, which can pass the primary current I12 from the center tap 16 of the primary coil 11 to the source terminal 12. To carry out the multiple ignition by rapid energization, the switch 133 is placed in the disconnected state, the switching element 32 is placed in the connected state, and the switching element 31 is placed in the connected state, which can pass the primary current I13 from the center tap 16 of the primary coil 11 to the GND terminal 14. Therefore, the ignition can be carried out with optimal power consumption.

In the above configuration, a three-state analog switching element may be used as the switch 133. That is, the switch 133 only has to be configured such that it can pass the current from the battery 82 to the source terminal 12 and can switch between a passing and a blocking state for a current from the source terminal 12 to the battery 82.

Figure 11:
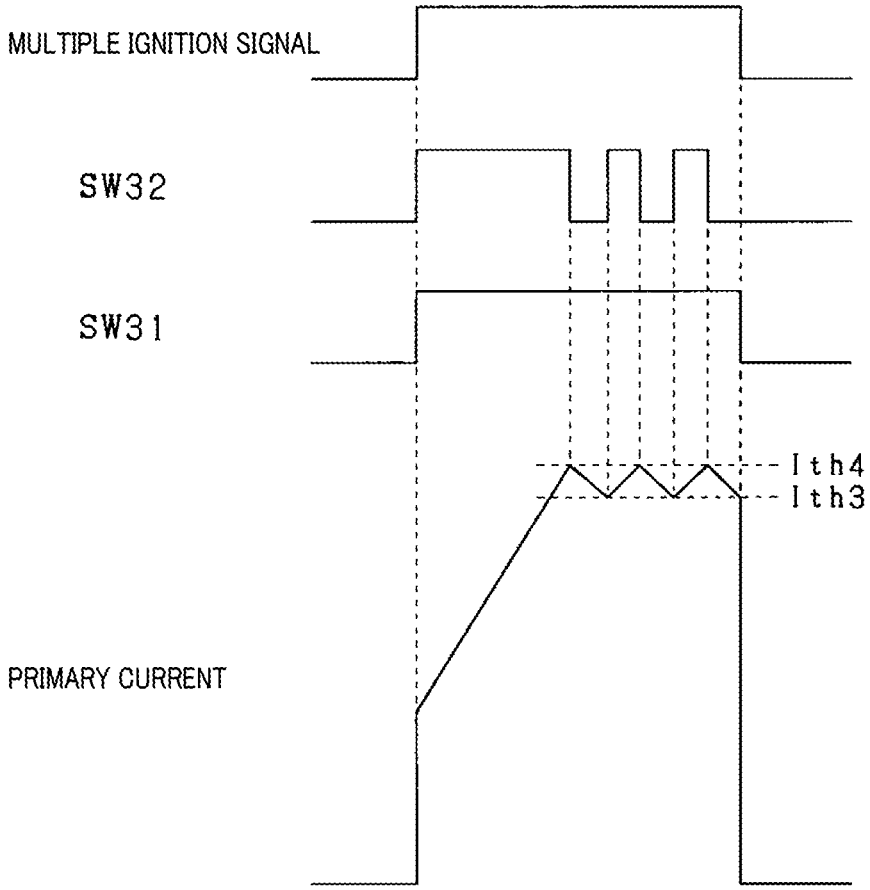
FIG. 11 is a timing diagram of a modification within a dashed-dotted line frame of FIG. 7.

(M2) FIG. 11 is a timing diagram of a modification within a dash-dotted line frame Sr of FIG. 7. The control circuit 60 may be configured to, after a spark discharge is generated at the spark plug 80, cause the switching element 32 to make or break the electrical connection between the boost circuit 50 and the center tap 16 alternately during a time period where (or while) the switching element 33 is placed in the disconnected state and the switching element 31 is placed in the connected state, thereby controlling the primary current I13 from the center tap 16 to the GND terminal 14. More specifically, the control circuit 60 is configured to feedback control the on/off state of the switching element 32 such that the primary current I13 detected by the current sensing resistor 47 is maintained between a lower limit Ith3 and an upper limit Ith4.

With this configuration, it is possible to store electrical energy in the second winding 11*b* of the primary coil 11 while inhibiting the primary current I13 from becoming excessively large. In addition, heat generation of the switching element 31 can be suppressed as compared to when the primary current I13 is controlled by controlling the magnitude of the gate voltage of the switching element 31 and adjusting a turn-on voltage and a switching activation level of the switching element 31. This can inhibit excessive temperature rise of the switching element 31 and can simplify a cooling structure for the switching element 31. Upon the switching element 32 being placed in the disconnected state, a freewheeling current flows through a freewheeling current path: GND->the freewheeling diode 41->the center tap 16->the GND terminal 14->the switching element 31->GND (see FIG. 6). This can suppress a rapid decrease in the primary current I13, which can lead to better control of the primary current I13.

Figure 12:
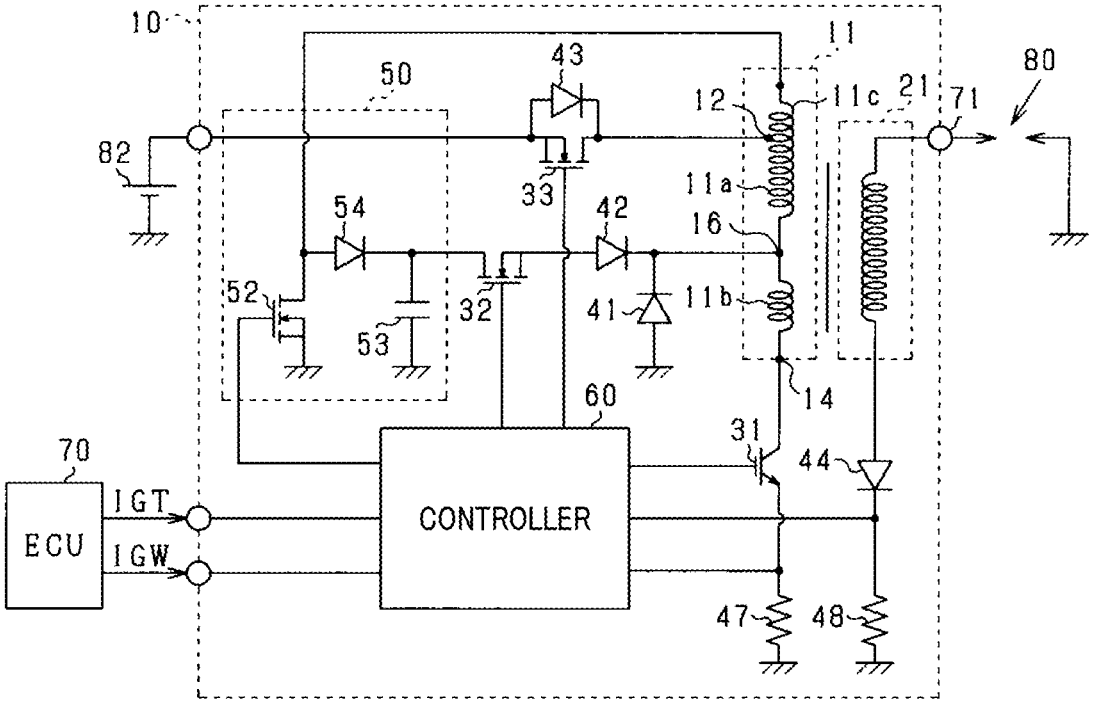
FIG. 12 is a circuit diagram of an ignition device in accordance with another modification.

(M3) As shown in FIG. 12, in place of the choke coil 51 of FIG. 1, part of the primary coil 11 (referred to as a third winding 11*c*) may be used as a choke coil of the boost circuit 50. In such an embodiment, the source terminal 12 is a second center tap of the primary coil 11. That is, the source terminal 12 may be provided at a point between the source side end and the center tap 16 of the primary coil 11.

Figure 13:
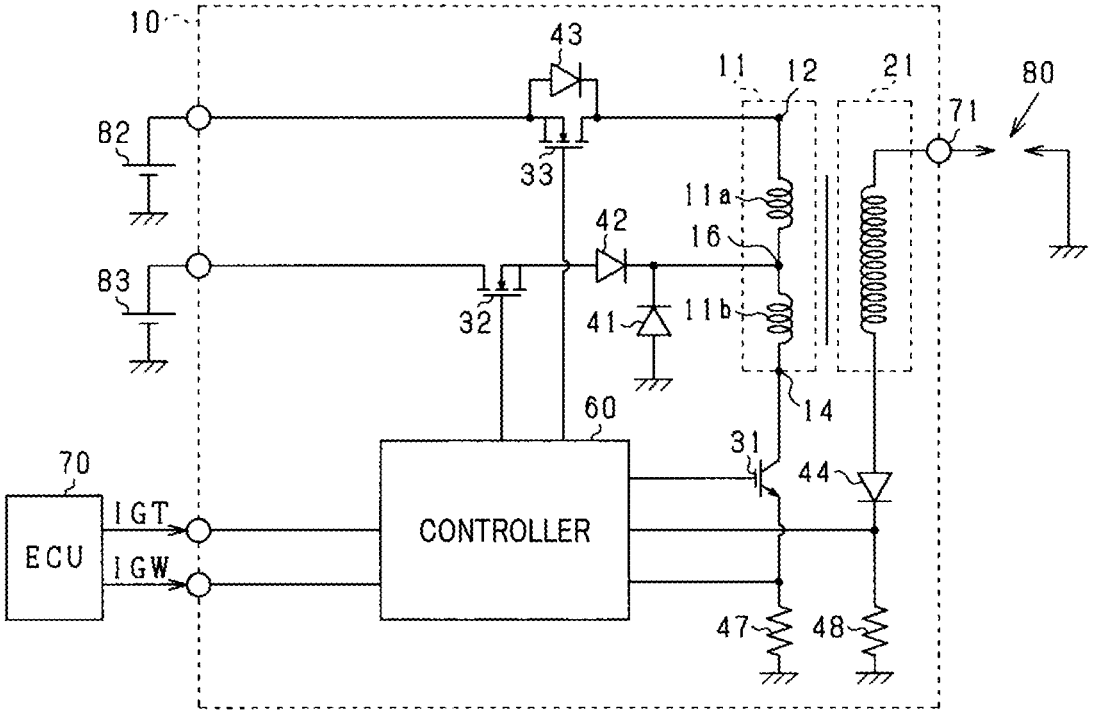
FIG. 13 is a circuit diagram of an ignition device in accordance with another modification.

(M4) As shown in FIG. 13, in place of the boost circuit 50 of FIG. 1, a battery 83 may be electrically connected to the switching element 32. The battery 83 (as a second supply) supplies a higher voltage (as a second voltage) than the voltage of the battery 82. For example, in cases where a vehicle has a battery 83 that supplies a voltage of 48 volts (V), the battery 83 may be used in place of the boost circuit 50. Such an embodiment can provide similar advantages to those of the above described embodiment. In addition, elimination of the boost circuit 50 allows the ignition device 10 to be downsized and cost reduced.

Figure 14:
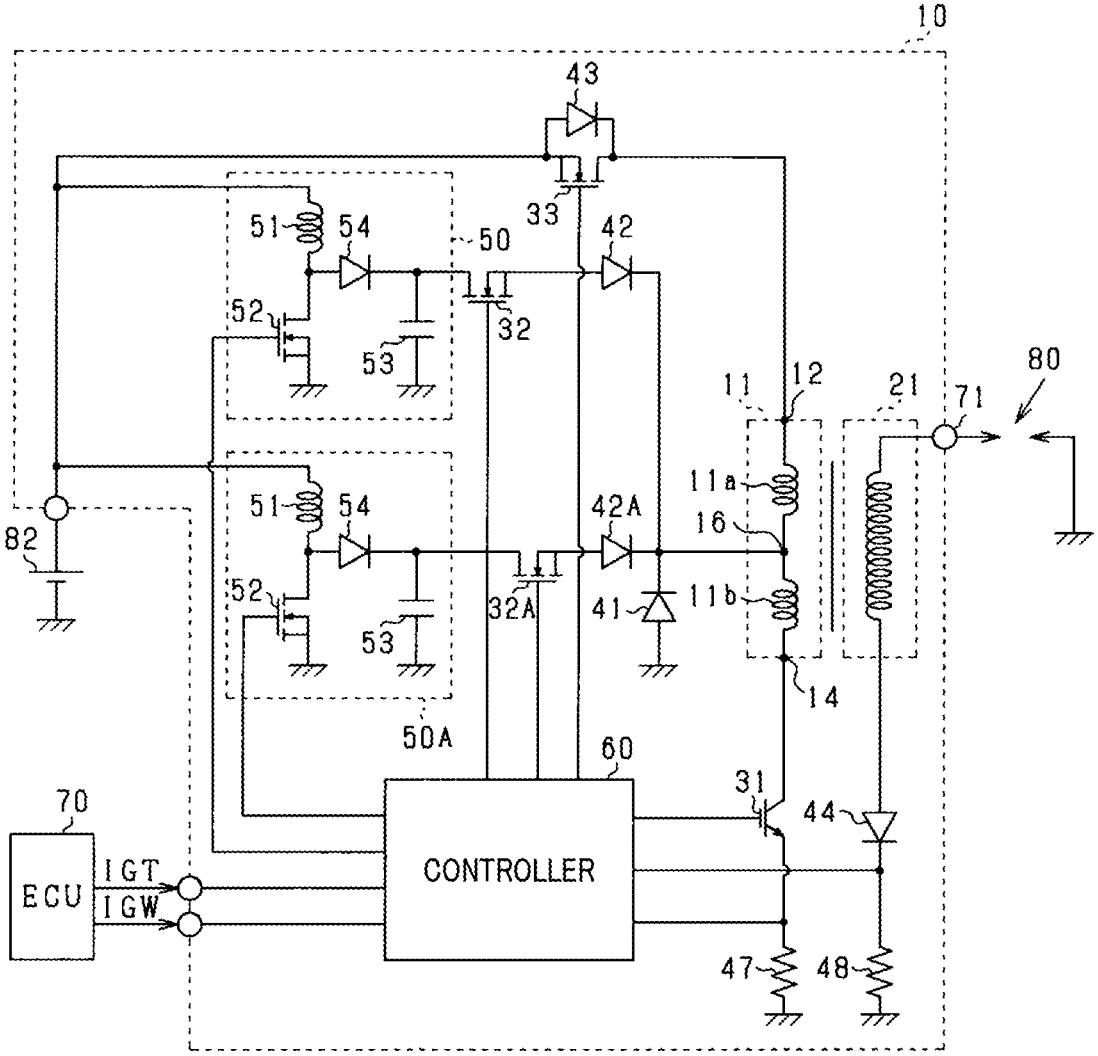
FIG. 14 is a circuit diagram of an ignition device in accordance with another modification.

(M5) As shown in FIG. 14, the ignition device 10 may include a boost circuit 50A, a switching element 32A (as a second switch), and a diode 42A, in addition to the boost circuit 50, the switching element 32, and the diode 42. The boost circuit 50A (as a second supply) outputs a higher voltage (of, e.g., 200V as a second voltage) than the boost circuit 50. The control circuit 60 may be configured to cause selected one of the switching elements 32, 32A to make or break an electrical connection between the boost circuit corresponding to the selected one of the switching elements 32, 32A and the center tap 16. In each of the boost circuits 50, 50A, the capacitor 53 may be charged to a specific voltage in advance in response to selected one of the ignition methods, where the voltage of the capacitor 53 may be detected to be feedback controlled.

With this configuration, the magnitude of voltage applied to the center tap 16 can be changed and the ignition of each method can be carried out at reduced power. For example, in the ignition by energy input, the switching element 32A making or braking the electrical connection between the boost circuit 50A and the center tap 16 allows the primary current flowing through the first winding 11*a*, thus the secondary current flowing through the secondary coil 21, to be increased. The engine speed is thus increased, so that even in an ignition environment where flame generated by the spark discharge tends to be blown out, the combustion of fuel is allowed to be continued. In the multiple ignition by rapid energization, if the voltage applied to the center tap 16 is too high, a voltage across the diode 44 generated upon initiation of energization of the second winding 11*b* may exceed its withstand voltage. Therefore, in the multiple ignition by rapid energization, the switching element 32 making or braking the electrical connection between the boost circuit 50 and the center tap 16 can inhibit occurrence of a discharge of reversed polarity at the spark plug 80.

(M6) The ECU 70 may be configured to cause the control circuit 60 to carry out any two of the three ignition methods.

(M7) The ECU 70 (as a controller) may be configured to further include all or some of the functions of the control circuit 60.

(M8) The ignition device 10 may be applied to an engine without the turbulent flow controller. The ignition device 10 may be applied to a spark ignition engine using fuel other than gasoline or mixed fuel with gasoline.

What is claimed is:

1. An ignition device for generating a spark discharge at a spark plug based on a first voltage and a second voltage higher than the first voltage, the first voltage being supplied from a first supply, the second voltage being supplied from a second supply, the ignition device comprising:

the second supply;

a primary coil including a center tap, a first terminal on a ground (GND) side of the center tap, and a second terminal on a first-supply side of the center tap;

a secondary coil electromagnetically coupled to the primary coil and electrically connected to the spark plug;

a first switch configured to make or break an electrical connection between the first terminal and GND;

a second switch configured to make or break an electrical connection between the second supply and the center tap;

a third switch configured to pass or interrupt a current from the second terminal to the first supply; and a controller configured to control an on/off state of each of the first switch, the second switch, and the third switch.

2. The ignition device according to claim 1, wherein the third switch comprises:

a diode with an anode electrically connected to the first supply and a cathode electrically connected to the second terminal; and a switching element electrically connected in parallel with the diode.

3. The ignition device according to claim 1, wherein the third switch is a specific switch configured to pass a current from the first supply to the second terminal, and pass or interrupt a current from the second terminal to the first supply.

4. The ignition device according to claim 1, wherein the controller is configured to cause the second switch to break the electrical connection between the second supply and the center tap, cause the third switch to make the electrical connection between the first supply and the second terminal, cause the first switch to make the electrical connection between the first terminal and GND, and subsequently cause the first switch to break the electrical connection between the first terminal and GND, thereby generating the spark discharge at the spark plug.

5. The ignition device according to claim 4, wherein the controller is configured to, after generating the spark discharge at the spark plug, cause the third switch to interrupt the current from the second terminal to the first supply, and cause the first switch to alternately make and break the electrical connection between the first terminal and GND while causing the second switch to maintain the electrical connection between the second supply and the center tap, thereby successively generating spark discharge at the spark plug.

6. The ignition device according to claim 4, wherein the controller is configured to, after generating the spark discharge at the spark plug, cause the first switch to break the electrical connection between the first terminal and GND, and cause the second switch to alternately make and break the electrical connection between the second supply and the center tap while causing the third switch to maintain the electrical connection between the first supply and the second terminal, thereby sustaining the spark discharge generated at the spark plug.

7. The ignition device according to claim 4, wherein the controller is configured to, after generating the spark discharge at the spark plug, cause the third switch to interrupt the current from the second terminal to the first supply, cause the second switch to alternately make and break the electrical connection between the second supply and the center tap while causing the first switch to maintain the electrical connection between the first terminal and GND, thereby controlling the primary current from the center tap to the first terminal, and cause the first switch to alternately make and break the electrical connection between the first terminal and GND, thereby successively generating spark discharge at the spark plug.

8. The ignition device according to claim 6, further comprising a freewheeling diode with an anode electrically connected to GND and a cathode electrically connected between the second switch and the center tap.

9. The ignition device according to claim 7, further comprising a freewheeling diode with an anode electrically connected to GND and a cathode electrically connected between the second switch and the center tap.

10. The ignition device according to claim 1, wherein the controller is configured to select one of three ignition methods in response to an environment in which the ignition is carried out at the spark plug and carry out the ignition according to the selected ignition method.

11. The ignition device according to claim 10, wherein the controller is configured to change the second voltage supplied from the second supply in response to the selected one of the three ignition methods.

12. An ignition device for generating a spark discharge at a spark plug based on a first voltage and a plurality of second voltages higher than the first voltage, the first voltage being supplied from a first supply, each of the plurality of second voltages being supplied from a respective one of a plurality of second supplies, the ignition device comprising:

the plurality of second supplies;

a primary coil including a center tap, a first terminal on a ground (GND) side of the center tap, and a second terminal on a first-supply side of the center tap;

a secondary coil electromagnetically coupled to the primary coil and electrically connected to the spark plug;

a first switch configured to make or break an electrical connection between the first terminal and GND;

a plurality of second switches, each of the plurality of second switches being configured to make or break an electrical connection between a respective one of the second supplies and the center tap;

a third switch configured to pass or interrupt a current from the second terminal to the first supply; and a controller configured to control an on/off state of each of the first switch, the second switch, and the third switch.

* * * * *